United States Patent [19]

Memminger et al.

[11] Patent Number: 4,651,938

[45] Date of Patent: Mar. 24, 1987

[54] ELASTOMETRIC YARN OR THREAD SUPPLY APPARATUS FOR TEXTILE MACHINES, PARTICULARLY KNITTING MACHINES

[75] Inventors: Gustav Memminger, Freudenstadt; Josef Fecker, Bissingen-Steinhofen, both of Fed. Rep. of Germany

[73] Assignee: Memminger GmbH, Freudenstadt, Fed. Rep. of Germany

[21] Appl. No.: 879,528

[22] Filed: Jun. 23, 1986

Related U.S. Application Data

[63] Continuation of Ser. No. 530,402, Sep. 8, 1983, abandoned.

[30] Foreign Application Priority Data

Sep. 13, 1982 [DE] Fed. Rep. of Germany ..... 3233869

[51] Int. Cl.[4] ..... B65H 49/34

[52] U.S. Cl. ..... 242/54 R; 242/18 DD; 242/131

[58] Field of Search ..... 242/54 R, 128, 131, 242/131.1, 1, 18 DD, 66, 67.1 R, 68.7, 78.7; 66/132 R, 132 T, 125; 74/378, 404, 417, 423

[56] References Cited

U.S. PATENT DOCUMENTS

| | | | |
|---|---|---|---|
| 385,111 | 6/1888 | Godwin | 74/404 |
| 1,357,712 | 11/1920 | Kok | 74/378 |
| 1,394,373 | 10/1921 | Tellefsen | 74/404 |
| 1,418,126 | 5/1922 | Cartlidge | 74/378 X |
| 2,110,272 | 3/1938 | Mayer | 74/404 |
| 3,035,451 | 5/1962 | O'Connell et al. | 74/404 X |
| 3,209,558 | 10/1965 | Cargill | 66/132 R |
| 3,303,671 | 2/1967 | Oliver, Jr. | 66/132 R |
| 3,590,601 | 7/1971 | Sugiura | 66/132 R |
| 3,812,736 | 5/1974 | Nickstadt | 74/404 |
| 3,922,887 | 12/1975 | Mishcon | 66/132 T |
| 4,055,311 | 10/1977 | Bock et al. | 242/18 DD |
| 4,067,507 | 1/1978 | Hamel | 242/18 DD |
| 4,128,213 | 12/1978 | Komulainen | 242/67.1 R |
| 4,141,516 | 2/1979 | Olson | 242/68.7 X |
| 4,202,506 | 5/1980 | Rohner | 242/36 |

FOREIGN PATENT DOCUMENTS

| | | |
|---|---|---|
| 1900722 | 8/1970 | Fed. Rep. of Germany . |
| 1760504 | 12/1971 | Fed. Rep. of Germany . |
| 443188 | 2/1936 | United Kingdom . |
| 445743 | 4/1936 | United Kingdom . |
| 453475 | 9/1936 | United Kingdom . |
| 729203 | 5/1955 | United Kingdom . |
| 730198 | 5/1955 | United Kingdom . |
| 893612 | 4/1962 | United Kingdom . |
| 1442573 | 7/1976 | United Kingdom . |

*Primary Examiner*—Stanley N. Gilreath

*Attorney, Agent, or Firm*—Frishauf, Holtz, Goodman & Woodward

[57] ABSTRACT

To permit pull-off of elastomeric yarn from a spool, without subjecting the yarn to tension, the spool (6) with the yarn (17) wound thereon is placed on a pair of horizontally extending support-and-drive rollers (3) which are driven at pull-off speed by a belt drive (7, 8, 10) from the textile machine via a right-angled drive (FIG. 3) from a drive pulley (11). The drive is reversible. The yarn is fed by frictional engagement of the yarn portion being pulled off the spool with a portion of the circumference of the driven support-and-drive rollers (3) and, if the weight of the spool is not sufficient to provide for suitable frictional engagement, the surfaces of the rollers can have knurling or a rubber coating thereon; they may be spring-loaded or weighted. Additional drive can be obtained by looping an endless belt (24) about the rollers, and seating the spool (6) in a concave depression formed by the belt as the spool is positioned between the support-and-drive rollers. The holder has a standard U-clamp to fit on the yarn supply holder ring of a circular knitting machine.

20 Claims, 7 Drawing Figures

FIG. 2
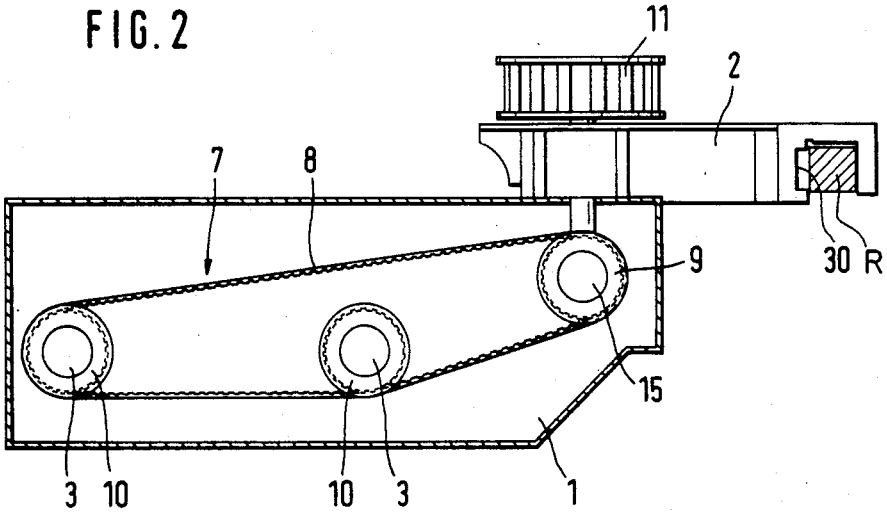
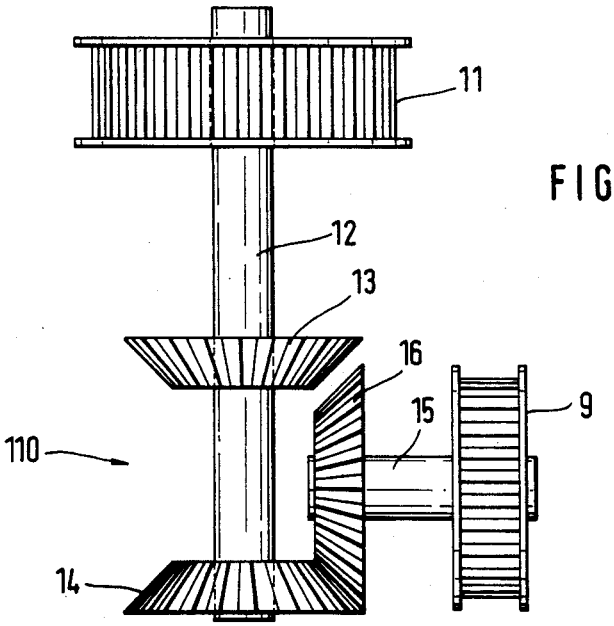
FIG. 3

ELASTOMETRIC YARN OR THREAD SUPPLY APPARATUS FOR TEXTILE MACHINES, PARTICULARLY KNITTING MACHINES

This application is a continuation of application Ser. No. 530,402, filed Sept. 8, 1983, now abandoned.

The present invention relates to yarn or thread supply apparatus for textile machinery to supply elastomeric yarn or thread thereto, and more particularly to elastomeric yarn or thread supply apparatus suitable for use with knitting machines, for example circular knitting machines.

BACKGROUND

Handling of elastic yarn or thread, such as yarn or thread having a rubberized or other elastic core, or thread which is inherently and only made of elastic material, causes difficulties since the thread should be pulled off a supply spool with essentially uniform tension, yet without stretching the thread. Due to the elasticity of elastomeric threads, it is not possible to merely pull such threads off a supply spool which is, for example, rotatably located on a vertical spindle. The pull-off spools must be driven so that the thread pull-off will not subject the thread being pulled off to substantial tension and, further, to provide for uniformity of tension as the thread is being supplied.

Various types of thread supply apparatus for elastomeric thread have been proposed—see, for example, U.S. Pat. No. 3,590,601; British No. 1,442,573; German Patent Disclosure Document DE-OS No. 1 760 504. Thread supply apparatus of these types have a spool holder mandrel or pin which, usually, is vertically oriented and rotatable about a vertical axis of rotation. The thread supply spool, secured to the pin, is spring-pressed to a drive element which, for example, is formed as a cylindrical roller, and frictionally coupled with the circumference of the thread supply spool. Rather than using a roller, it is possible to engage a portion of the circumference of the supply spool, or of a plurality of spools, with a belt passing thereabout which is guided by suitable guide rollers, and driven at an appropriate speed, as well known.

Thread supply for a circular knitting machine usually employs an endless drive belt or tape which operates in a horizontal plane and drives various thread supply elements which are rotatable about vertical drive axes. The belt or tape is coupled with associated belt pulleys.

Placing spools on the respective holder pins or mandrels is comparatively complex and time-consuming, particularly if the thread is to be changed. It is not readily possible to associate a plurality of spools, for example containing threads of different colors, with one supply apparatus, although it would be advantageous to do so.

Belt as well as rim or circumferential drives have an additional disadvantage: As the thread is being used, the frictional engagement between the drive rollers or drive belts, and the cylindrical drive element itself, becomes less, so that it is necessary to press the spool and the drive element against each other with increasing force in order to prevent undesirable slippage therebetween.

Similar considerations apply to supply apparatus for elastomeric threads as known in the art, in which a common drive roller is provided for a plurality of pull-off spools, all positioned in a common horizontal plane. The drive roller is driven by a continuously variable speed drive and relative pressure of the drive roller with respect to the spools is effected. The spools are secured to pins or mandrels which are pivotable on pivot arms which, in turn, are movable about a common axis, and are biassed in direction towards the drive roller by spring pressure.

THE INVENTION

It is an object to provide a thread supply system and apparatus for elastomeric threads which permits easy exchange of spools, provides for excellent supply of thread, and, additionally, is capable of use with more than one spool at any thread supply or feeding position.

Briefly, the spools, rather than being maintained vertically, are supported on a pair of elongated support-and-drive rollers which are spaced from each other by a distance which is less than the circumferential distance of the spool, so that the spool can be placed in the space between the rollers. At least one of the rollers is driven, thus providing positive drive to the spool. If the spool is heavy, it may rest on the two rollers with its own weight; otherwise, a simple pressure arrangement can be used.

In effect, the spool is retained as on a cradle with two rolling supports, of which at least one is driven. The drive speed will depend on the thread requirements by the textile machine to which the supply apparatus is coupled. The rollers can be made sufficiently long so that more than one spool can be placed thereon, the spools being located in axially stacked arrangement.

The arrangement has the advantage that the respective spools are merely freely laid on the two rollers, where they will reliably support the spool carrier or spool form until the thread is used up. As the diameter of the spool decreases, with increasing use of thread, the spools will, automatically, engage deeper in the space or gap between the rollers. The result will be that the drive angles which are effective to form the frictional coupling between the outer surface and the spools become more effective, so that the elastic thread will be securely fed to the textile utilization machine, until the thread on the spool is exhausted.

It is no longer necessary to fit the spools on support pins or mandrels; special drive cores are not needed, and change of spools is particularly simple. The overall arrangement of the apparatus is simple and straight-forward and can be easily made.

In accordance with a feature of the invention, the thread which is supplied by one of the spools can be guided and looped over one of the driven rollers. This has the advantage that the roller will contribute to positive feed of the thread even after the thread has left the spool. Additionally, the thread portion being pulled off will separate easily from the remainder of the windings or loops of threads still on the spool. Since elastomeric threads often are slightly sticky, and the windings of loops on the spool have a tendency to adhere to each other, positive pull-off and guidance of the threads by the very same element which also supports and drives the thread pull-off mechanism insures appropriate separation of the thread portion being pulled-off, and thus contributes to uniformity of tension as the thread is being supplied to the utilization apparatus, typically a circular knitting machine.

DRAWING

FIG. 2 is a schematic side view of the yarn supply apparatus looked at in the direction of the arrows II—II of FIG. 1 shown attached to a knitting machine;

FIG. 3 is a schematic side view of the bevelled gear drive, to a different scale;

DETAILED DESCRIPTION

Figure 1:
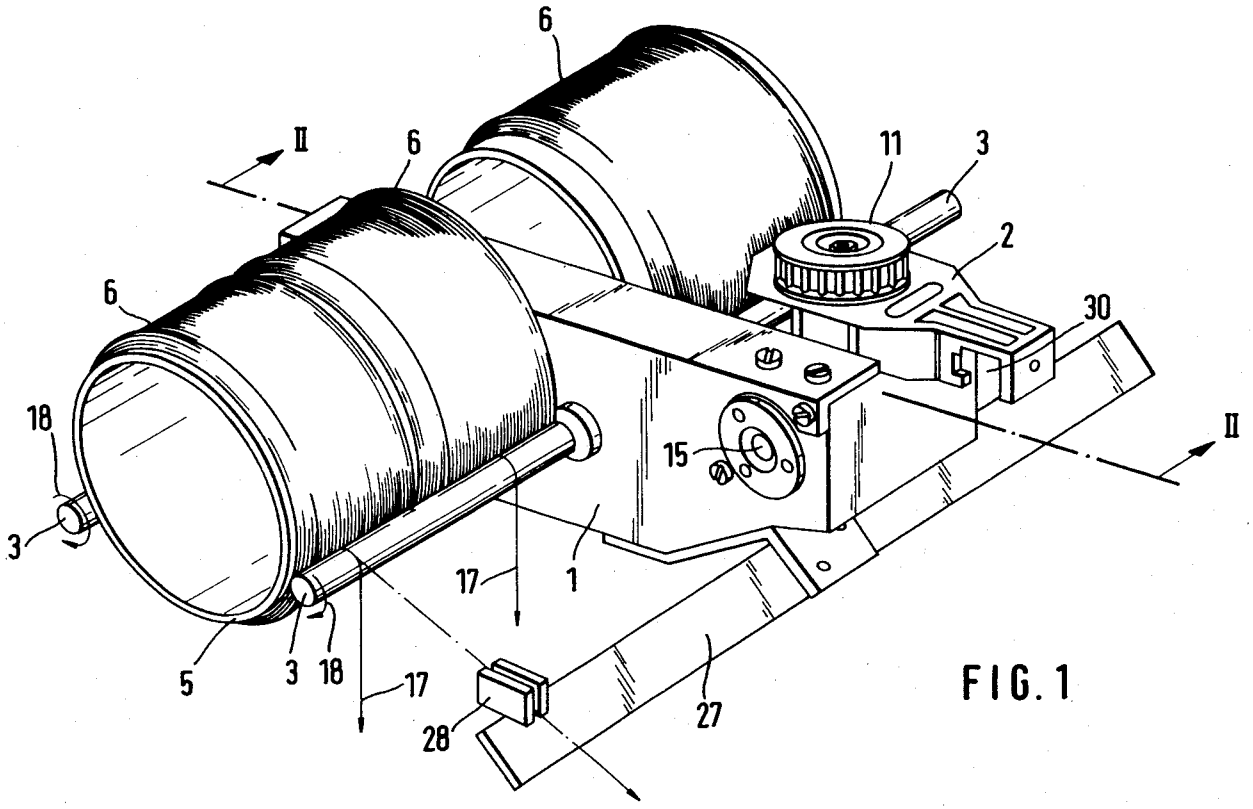
FIG. 1 is a perspective view of the yarn supply apparatus for elastomeric yarns.

A support or holder 1 (FIGS. 1, 2) has an elongated hollow housing which is formed with a laterally projecting attachment bracket 2, shaped preferably to be hooked about a yarn supply holder ring R of a knitting machine shown only in FIG. 2 for simplicity, since such rings are well known. The end of the bracket 2 carries a U-shaped clamping hook holder 30, to attach the holder 1 to the holding ring of a circular knitting machine as well known. The thread or yarn supply thus is directly attachable to standard circular knitting machines and interchangeable with thread or yarn supply apparatus standard in the industry. The holder 1 retains two support-and-drive rollers 3. The rollers 3 are rotatably journalled in the holder 1 terminating in free ends and extend in two opposite directions from the holder 1, as best seen in FIG. 1. The two cylindrical rollers 3, when operatively coupled to a knitting machine, project in cantilever manner horizontally or essentially so. The spacing of the axes of rotation of the rollers 3 is so selected that the circumference of the rollers 3 will have a minimum distance 4—see FIG. 6—which is less than the external diameter of the spool holder 5 of a spool 6 placed on the rollers 3 and retained thereon, for example by gravity. Thus, even if the spool holder 5 should be empty, without and thread thereon, it cannot fall through the gap between the rollers 3, since the distance 4 is less than the diameter of the empty spool holder 5.

The two rollers 3 are coupled to a drive arrangement for positive drive. A gear or toothed belt or sprocket drive 7—see FIG. 2—is located within the holder 1. An endless belt 8 is looped about a drive pulley 9 and on two engagement pulleys 10 which are coupled to the shafts of the rollers 3 in rotation-transmitting relationship. The drive pulley 9 is coupled to a vertical drive wheel 11 over a bevel gearing 110, best seen in FIG. 3.

Gearing 110 is so arranged that the direction of rotation of the drive pulley 9 can be reversed. Two bevel gears 13, 14 are secured to a shaft 12 which, in turn, is secured to the drive wheel 11. The spacing of the bevel gear 13, 14 is wider than the diameter of the engagement bevel gear wheel 16, which is coupled over a shaft 15 with the drive pulley 9. Upon axial movement of the shaft 12, either bevel gear 13 or 14 can be engaged with the gear wheel 16, thus selecting the direction of rotation of the pulley 9.

Shaft 12 is retained within the holder 1 and extends directly above the bracket 2—see FIG. 1. The axial position of the shaft 12 can be selected and locked in position by a suitable shift mechanism, for example by selectively positioning a thrust bearing at the bottom of shaft 12, and maintaining the shaft in the selected axial position, for example by spring pressure, if its own weight will not suffice. The position of shaft 12 places the drive wheel 11 between the clamping hook holder 30, at one end of the holder 1, and the rollers 3.

Referring again to FIG. 1: Three thread supply spools 6 are located on the drive and support rollers 3. The spools 6 are solely supported by the roller 3, and are driven thereby. The number of spools 6 can be selected, as required, and is determined and limited only by the length of the rollers 3. As can be clearly seen, spools of different diameters, and different axial lengths, can be placed on the rollers 3.

The elastomeric thread 17 being taken off the respective spools is guided over one of the driven rollers 3, so that it will run off in a direction which is downward with respect to the axes of the rollers 3 and, preferably, at an inclination with respect to a plane passing through the rollers 3. Both rollers 3 are driven to rotate, as schematically shown by arrows 18 (FIG. 1). The spool 6 and the thread thereon, that is, the circumference of spool 6, is frictionally coupled with the rollers 3; one of the rollers 3, additionally, provides for positive pull-off of the respective thread 17 as it passes thereover.

Figure 7:
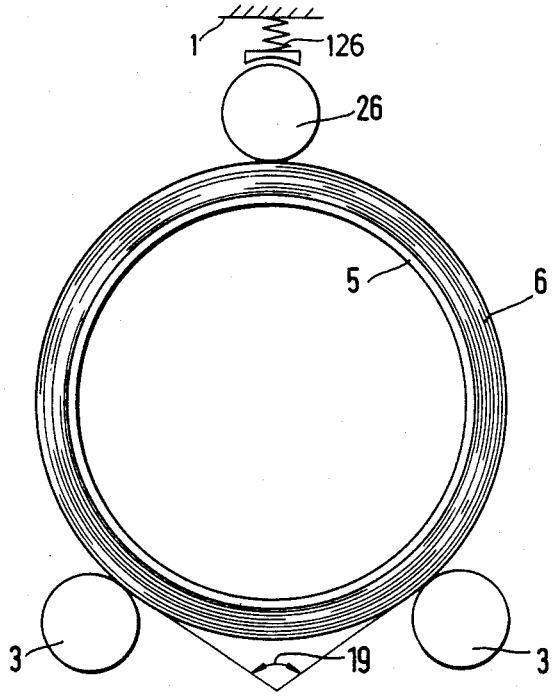

As thread is used, the diameter of the spool 6 will decrease. Consequently, the spool 6 will drop lower between the rollers 3. FIG. 7 illustrates the engagement angle 19 between the circumference of the spool 6 and the two rollers 3. As can be clearly seen, if the diameter of the spool 6 decreases, angle 19 will likewise decrease, which increases the frictional engagement between the rollers 3 and spool 6. Thus, as yarn is used, the effect of friction on the drive increases, which is the desired relationship.

Figure 4:
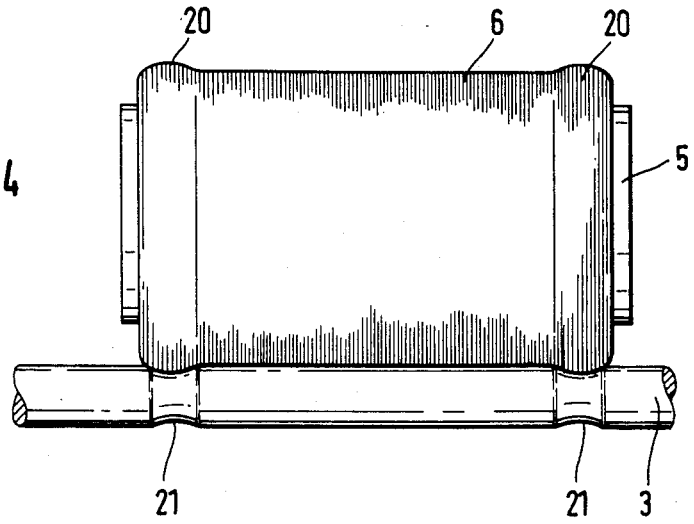
FIG. 4 is a highly schematic fragmentary side view of another embodiment of the drive.

When thread is wound on a spool form 5, particularly if the thread is elastomeric thread, it frequently happens that the end windings of loops overlap, so that the spool will assume the shape shown in FIG. 4, with enlarged rim portions 20 of thread on the thread carrier or spool carrier 5. FIG. 4 shows the end bulges somewhat exaggerated for clarity. It may, then, occur that the spool 6 is engaged by the rollers 3 only at the end portions, where the bulges 20 occur. To provide for frictional engagement of the rollers 3 with the spool 6 over essentially the entire axial length of the spool 6, rollers 3 may be formed with shallow grooves 21. Grooves 21 can be positioned at suitable locations where bulges of the spool 6 are to be expected.

Figure 5:
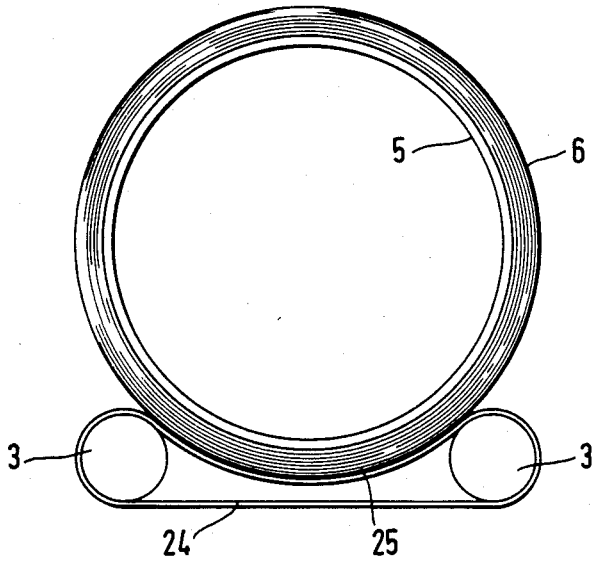
FIGS. 5, 6 and 7 are end views, respectively, showing only the drive arrangement for the spool, and omitting all components not necessary for an understanding of the difference in the embodiments, the details of which are shown in FIGS. 1-3.
Figure 6:
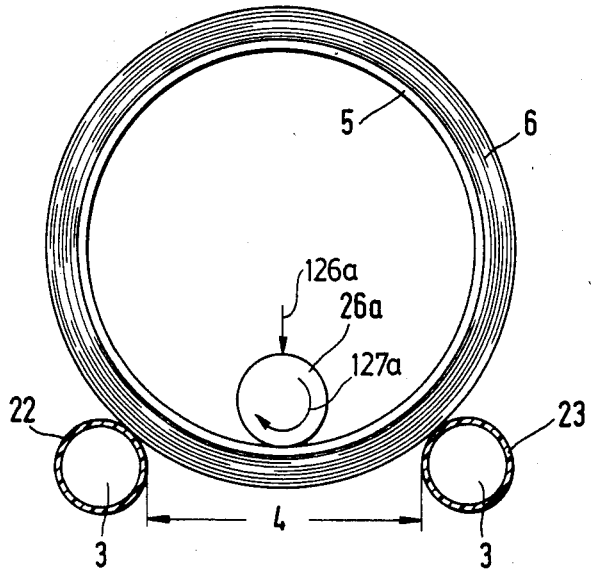

The two rollers 3 preferably are formed with a frictionenhancing surface. Referring to FIG. 6: The surface of the rollers 3 can be coated or covered with a rubber or plastic layer 23, or otherwise formed with means which increase the surface friction, thus increasing the frictional engagement and drive effect of the rollers 3 with respect to the spool 6. In some arrangements, it may be desirable to loop an endless belt or tape 24 (FIG. 5) about the rollers 3 against which the spool 6 can engage, so that spool 6 is cradled not only between the rollers but, additionally, by the tape 25 which will form a depression or groove-like, part-circular concave portion 25, which automatically and inherently will fit against and engage the spool 6. The tap or belt 24 thus increases the circumferential portion of the positive drive elements which are engaged with the spool 6, since the belt 24 will be driven from the rollers 3. Knurling or ribbing 22 enhances friction.

Usually, the inherent weight of the spools 6 is enough in order to insure reliable thread transport. For some spools, which are small, or which have spool carriers 5 which are very light, additional engagement force between the spool 6 and the rollers 3 may be desirable. In accordance with a feature of the invention, holder 1 has a third laterally projecting pressure roller 26 extending therefrom (not shown in FIG. 1) which, as seen for example in FIG. 7, engages the top of the spool 6 and loads the spool 6 with respect to the rollers 3. Roller 26, of course, is rotatable and may be spring-loaded or biassed downwardly. Rather than using a single pressure roller 26, two or more pressure rollers may be used, for example—and referring to FIG. 7—located approximately symmetrically with respect to the support and drive rollers 3 and positioned thereon. The additional rollers may merely ride on the spool 6, supplying pressure against the rollers 3 by their own weight. Alternatively, the roller 26, or the roller array, can be driven and, if necessary, additionally spring-loaded, as seen at 126.

FIG. 6 illustrates another embodiment in which the additional roller 26*a* is located to extend into the hollow spool carrier 5, and loads the spool carrier 5 by a force 126*a*, and hence the spool 6 in the direction of the drive and support rollers 3. Roller 26 is preferably guided for movement up-and-down in the holder 3, although it may also be left loose within the spool 5. Its size and weight can be suitably selected so that spring loading will be unnecessary. Roller 26*a*, preferably, is an idler, although it may be driven, as shown schematically by arrow 127*a*.

The rollers 26, 26*a* are located on the holder 1 for limited vertical movement, slidably positioned, and—if desired—spring-loaded, so that the necessary engagement force 126*a* can be applied on the spool 6, or the spool carrier 5, respectively. A rail 27 secured to holder 1, carries, slidably and selectively positionable thereon, a non-contacting thread supervisory apparatus 28. Such apparatus is well known and forms a commercial article. The non-contacting thread supervisory elements 28—of which only one is shown—are located to monitor the respective spools 6, and the thread 17 therefrom, without, in any way, interfering with the tension on the thread. The thread can readily oscillate axially back-and-forth, as it is unwound from the spool 6, without being affected by stickiness or adhesive material on the surface of the thread. The position of the rail 27 and the thread guides 28 can be suitably selected, so that the thread 17 will reliably pass between the monitoring element 28 regardless of its initial pull-off position. The operating pull-off position of the thread 17 is shown in chain-dotted lines, the solid lines 17 indicating vertical pull-down for illustration of the wrap angle which can be obtained by the system of the present invention about the rollers 3. If the pull-off of the yarn is in the direction of the solid line 17, the rail 27 can be reversed on the holder 1 which will then place the thread sensor 28 in the path of the thread 17, as shown by the solid lines.

The sprocket chain or chain belt drive (FIG. 2), coupled via axially positionable bevel gears (FIG. 3) to a drive pulley, is a simple, and since preferred, arrangement. The drive pulley 11, itself, is of the type suitable for engagement with a gear belt standard on circular knitting machines to drive yarn supply apparatus. The arrangement thus permits easy exchange of yarn supply apparatus which are well known, to supply, for example, essentially inelastic yarn with the apparatus as described, and shown in FIG. 1.

The direction of rotation of the pull-off of the rolls can be selected as desired. The bevel gear drive is an extremely simple and reliable rotation-reversal arrangement.

Rather than using a jacket or cover of rubber, or other elastic high-friction material 23 (FIG. 6), surface shaping 22 of the rollers may be used, for example by knurling, serrating the surface, or the like. This arrangement may also be used with the embodiment of FIG. 5 to provide for positive drive of the engagement belt 24. The belt itself, preferably, is made of a material having a surface facing the spool 6 which has high friction, for example of rubber, or high-friction plastic material which, additionally, may be striated, serrated, or stippled. Stippling, knurling and the like, or coating with high-friction surface material can be used with any one of the rollers, also with the rollers having the grooves 21 to accept possible end bulges 20 on the spools—see FIG. 4.

Usually, the inherent weight of the spool 6 provides for sufficient frictional engagement between the rollers 3 and the spool 6. If the spool 6 or the spool forms or carriers 5 are very light, however, or upon high pull-off speeds, it is possible that sufficient frictional engagement between the rollers 3 and the spool 6 will not obtain, and, then, the embodiment shown in FIGS. 6 and 7, with an additional pressure roller, is desirable. The pressure roller can apply pressure 126*a* externally to the circumference of the spool 6, or internally, against the hollow interior of the spool carrier 5.

The system is particularly adapted for use with accessory apparatus which does not introduce additional tension on the thread or which might adhere to an elastomeric yarn which, inherently, is somewhat sticky or adhesive on its surface. Stop-motion apparatus or thread monitoring and supervisory apparatus, thus, should preferably be of the non-contacting type, for example by using a capacitative or optical sensing element and, preferably, is associated with and secured to the holding structure 1 of the thread supply apparatus.

Various changes and modifications may be made, and features described in connection with any one of the embodiments may be used with any of the others, within the scope of the inventive concept.

We claim:

1. In combination with a knitting machine requiring supply of yarn or thread for knitting operation, and consumption of yarn or thread during knitting, said knitting machine having a yarn supply holder ring (R) with an elastomeric yarn or thread supply apparatus and two yarn or thread supply spools (6) having elastomeric yarn or thread (17) wound on respective spool carriers (5), said apparatus comprising an elongated holder structure;

a single attachment means (2, 30) secured to said holder structure and located at one end portion of the holder structure, said attachment means being dimensioned and shaped for attachment to the holder ring (R) of the knitting machine;

two pairs of essentially horizontally positioned spool support-and-drive rollers (3) located at another end portion of the holder structure, said pairs projecting horizontally, each in opposite directions, from said holder structure (1), said support-and-drive rollers (3) being rotatably supported solely in the holder structure (1) cantilevered from said holder structure, said holder structure rotatably retaining the pairs of the drive rollers in said essentially horizontal position when attached to the machine, said drive rollers of the pairs being spaced from each other such that the minimum circumferential distance (4) between said support-and-drive rollers is less than the outer diameter of the spool carriers (5) of the spools (6), one of said spools being positioned on a pair of said spool support-and-drive rollers (3) extending in one of said directions, and another one of said spools being located on a pair of said support-and-drive rollers extending in the opposite of said directions to thereby locate the holder structure centrally of the two pairs of support-and-drive rollers and to support said spools (6) on the holder structure in balanced position;

and means (7, 110) comprising a drive connection to the support-and-drive rollers (3) to rotate the spools (6) positioned on said pairs of support-and-drive rollers, with a portion of the circumference of each spool (6) spanning said distance (4), said spool drive connection comprising a rotation transmitting drive (8) located within the holder;

a drive wheel (11) having an axis of rotation extending at right angles to the axis of rotation of said support-and-drive rollers (3);

and a right-angle drive (110) between said drive wheel (11) and the rotation transmitting drive (8), said rotation transmitting drive being located in driving engagement with at least one of said support-and-drive rollers (3).

2. Apparatus according to claim 1, wherein the thread (17) being taken off at least one of the spools (6) is looped about a portion of the circumference of one of the driven rollers (3).

3. Apparatus according to claim 1, wherein the drive connection includes a reverse gearing arrangement (13, 14, 16) coupled to drive the support-and-drive rollers (3), selectively, in either direction.

4. Apparatus according to claim 1, wherein the right-angle drive comprises a pair of spaced bevel gears (13, 14) and an engaging bevel gear of lesser diameter than the spacing between the spaced bevel gears forming said pair of bevel gears, one of the bevel gears of said pair being selectively engageable with the engaging bevel gear (16) for, respectively, predetermined selection of the direction-of-rotation of said bevel gear;

and means (9, 15) for coupling the engaging bevel gear with said rotation transmitting drive (8).

5. Apparatus according to claim 1, wherein at least one of said rollers is formed with a high-friction surface (22, 23).

6. Apparatus to claim 5, wherein said high-friction surface comprises a sheathing or surface layer of high-friction material (23).

7. Apparatus according to claim 5, wherein said high-friction surface comprises a knurled or ribbed or stippled surface (22).

8. Apparatus according to claim 1, including an endless tape or belt forming a concave depression fitting against the portion of the circumference of the spool (6), located between the surfaces of said support-and-drive rollers (3) and looped thereabout.

9. Apparatus according to claim 1, wherein the support-and-drive rollers (3) are formed with grooves (21) or zones of lesser diameter to accomodate terminal bulge areas (20) of the spools (6).

10. Apparatus according to claim 1, further including a pressure roller (26, 26*a*) in engagement with the spool (6) and providing a downwardly directed force (126*a*) pressing the spool against said pair of support-and-drive rollers (3).

11. Apparatus according to claim 10, wherein the spool carrier (5) is hollow;

and said pressure roller comprises a roller (26*a*) extending into the hollow region of the spool carrier and loading the spool carrier, and hence the spool, downwardly and towards said pair of support-and-drive rollers (3).

12. Apparatus according to claim 1, further including a contactless thread monitoring apparatus (28) located in the path of the thread being drawn off the spool (6).

13. Apparatus according to claim 1, further including a contactless thread monitoring apparatus (28) located in the path of the thread being drawn off the spool (6);

said thread (17) being partially looped about at least one of said driven support-and-drive rollers (3).

14. Apparatus according to claim 10, wherein said pressure roller is driven to provide additional drive to the spool by frictional engagement of the surface of said pressure roller.

15. Apparatus according to claim 1, wherein said rotation transmitting drive comprises a gear belt or sprocket belt.

16. Apparatus according to claim 1, wherein the elongated holder structure (1) is hollow and retains said rotation transmitting drive (8) and said right-angle drive (110); and a shaft (12) is provided located near said one end portion of the holder and projecting from said holder structure, said drive wheel (11) being mounted on said shaft.

17. Apparatus according to claim 16, wherein said rotation transmitting drive comprises a gear belt or sprocket belt.

18. Apparatus according to claim 1, wherein said support-and-drive rollers (3) are rotatably journalled and supported solely in the holder (1).

19. Apparatus according to claim 16, wherein said support-and-drive rollers (3) are rotatably journalled and supported solely in the holder (1).

20. Apparatus according to claim 1, wherein the elongated holder structure retains said rotation transmitting drive (8) and said right-angle drive (110);

and a shaft (12) is provided located proximate said single attachment means (2, 30), said shaft projecting from said holder structure and retaining said drive wheel (11) thereon externally of said holder structure.

* * * * *